US005364323A

United States Patent [19]

Liu

[11] Patent Number: 5,364,323

[45] Date of Patent: Nov. 15, 1994

[54] MULTI-DIRECTIONAL ROTATABLE WRIST EXERCISER

[76] Inventor: Tony Liu, No. 460, Guang-Fuh Road, Beei-Doou Jenn, Jang Huah Hsien, Taiwan, Prov. of China

[21] Appl. No.: 118,274

[22] Filed: Sep. 9, 1993

[51] Int. Cl.[5] ..... A63B 23/14

[52] U.S. Cl. ..... 482/45; 482/124; 601/40

[58] Field of Search ..... 482/44, 45, 46, 122, 482/124, 127, 128; 601/23, 33, 40; 602/16, 21

[56] References Cited

U.S. PATENT DOCUMENTS 5,100,126 3/1992 Liou ..... 482/46

FOREIGN PATENT DOCUMENTS 1667859 8/1991 U.S.S.R. ..... 601/40

*Primary Examiner*—Richard J. Apley
*Assistant Examiner*—Jeanne M. Mollo
*Attorney, Agent, or Firm*—Lowe, Price, LeBlanc & Becker

[57] ABSTRACT

A structure for a multi-directional rotatable wrist exerciser comprising an arm covering body and a movable base. Said arm covering body and the movable base are pivotally connected together but movable by spiral springs which are made of harden materials. Since the harden spiral springs are free to turn in any direction, a user can therefore use the wrist exerciser to work out his wrist. The stretching of the springs generate a restoring force which the user tries to overcome through wrist exercising.

1 Claim, 6 Drawing Sheets

MULTI-DIRECTIONAL ROTATABLE WRIST EXERCISER

BACKGROUND OF THE INVENTION (a) Field of the Invention

The present invention relates to a wrist exerciser, particularly to the one which can be rotated in any direction while exercising.

(b) Description of the Prior Art

A conventional wrist exerciser is shown in FIG. 1. This wrist exerciser mainly consists of a semi-arc-shaped arm covering body 10, the open end on the bottom edge of which is attached to two Velcro straps 11 and 12. The top surface of a user's arm can be fitted into the arm covering body 10 so that the Velcro straps 11 and 12 can be strapped together. Each of the two bottom edges of the forward portion of the arm covering body 10 has a raised plate 13 the central portion of which has a bolt hole. The top surface of the arm covering body 10 has a clamping base 14 which has a plurality of insertion holes 141.

At the forward end of the arm covering body 10 a U-shaped movable base 2 is pivotally connected to the raised plate 13. Such connection is made by using a horizontal bolt 32 to feed through a concave groove 21 and the bolt hole of the raised plate 13 so that they are pivotally connected together but movable. The movable base is designed to be movable up and down. The top surface of the movable base 2 has a clamping base 23 which is in a corresponding position with the clamping base 14 on the arm covering body 10. Said clamping base has a plurality of insertion holes 231. The front end of the movable base 2 is pivotally connected to a handle 3. An appropriate number of resilient plates 4 can be attached between the clamping bases 14 and 23 of the arm covering body 10 and the movable base 2.

By such configuration, a user's arm is wrapped inside the arm covering body 10 and strapped together by the Velcro straps 11 and 12. The user can use his fingers to grab onto the handle 3. The wrist then moves up and down to overcome the tension of the resilient plates, so as to exercise the wrist of the arm.

The above wrist exerciser is usable. However, the following drawbacks exist on the conventional wrist exerciser:

1. Since the movable base 2 is pivotally connected to the arm covering body 10 by the use of the concave groove 21, the user can only have up-and-down movement of the wrist. Hence, the training effect is restricted. The wrist cannot move in any direction to give a complete exercising effects.

2. The resilient plates 4 in the conventional wrist exerciser is made out of flexible materials. They tend to loose their effectiveness after a period of time. It is inconvenient to replace them.

Hence, the Inventor, after years of accumulated experiences in the related business, has come up a new structure of the multi-directional rotational wrist exerciser. In accordance with our invention, we overcome the above and other difficulties by providing a new structure of the wrist exerciser which is simple of construction and practical of design.

SUMMARY OF THE INVENTION

The main object according to the present invention is to provide a multi-directional rotatable wrist exerciser which uses springs of harden material to pivotally connect the arm covering body and the movable base together. This allows a user to rotate his wrist in any angle so as to get a complete exercising result on the wrist.

Another object according to the present invention is to provide a multi-directional rotational wrist exerciser which users springs of harden material so that the springs will not be loosen even after the repeated stretching in exercising.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
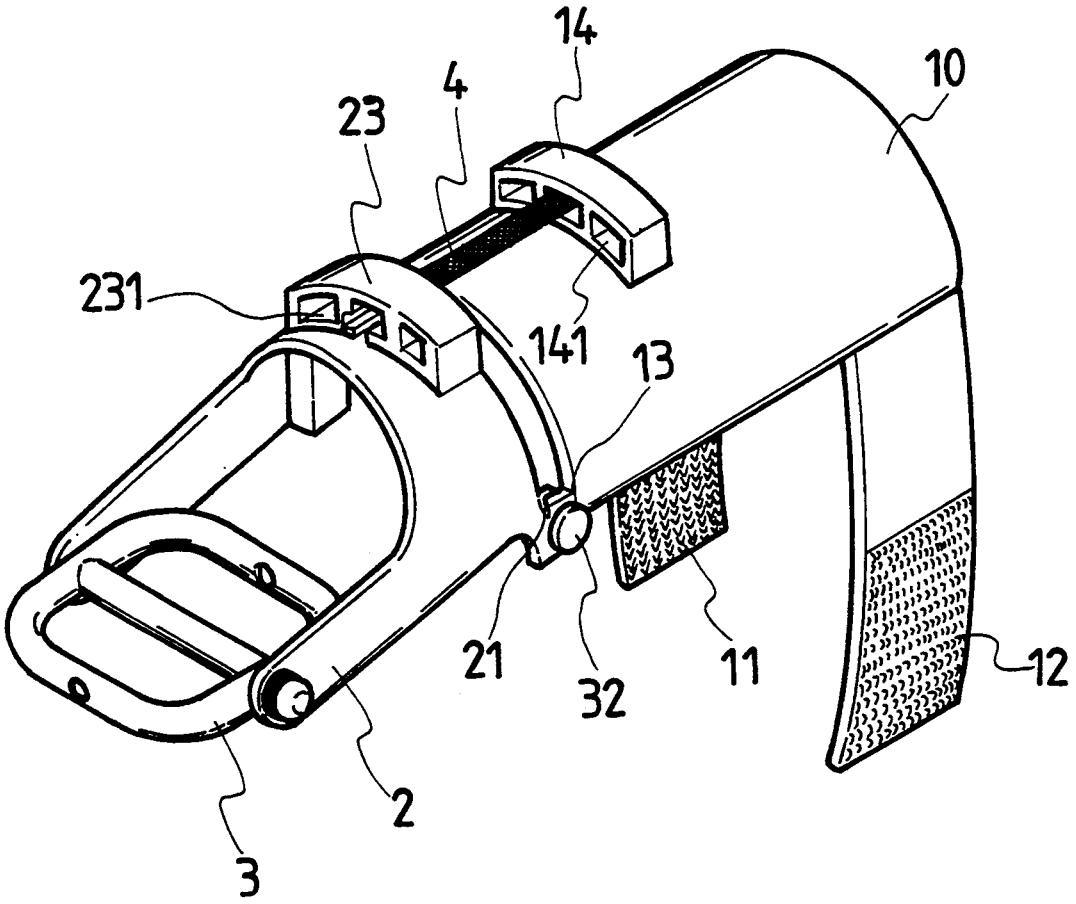
FIG. 1 PRIOR ART
FIG. 1 is a perspective view of the wrist exerciser from prior art.
Figure 2:
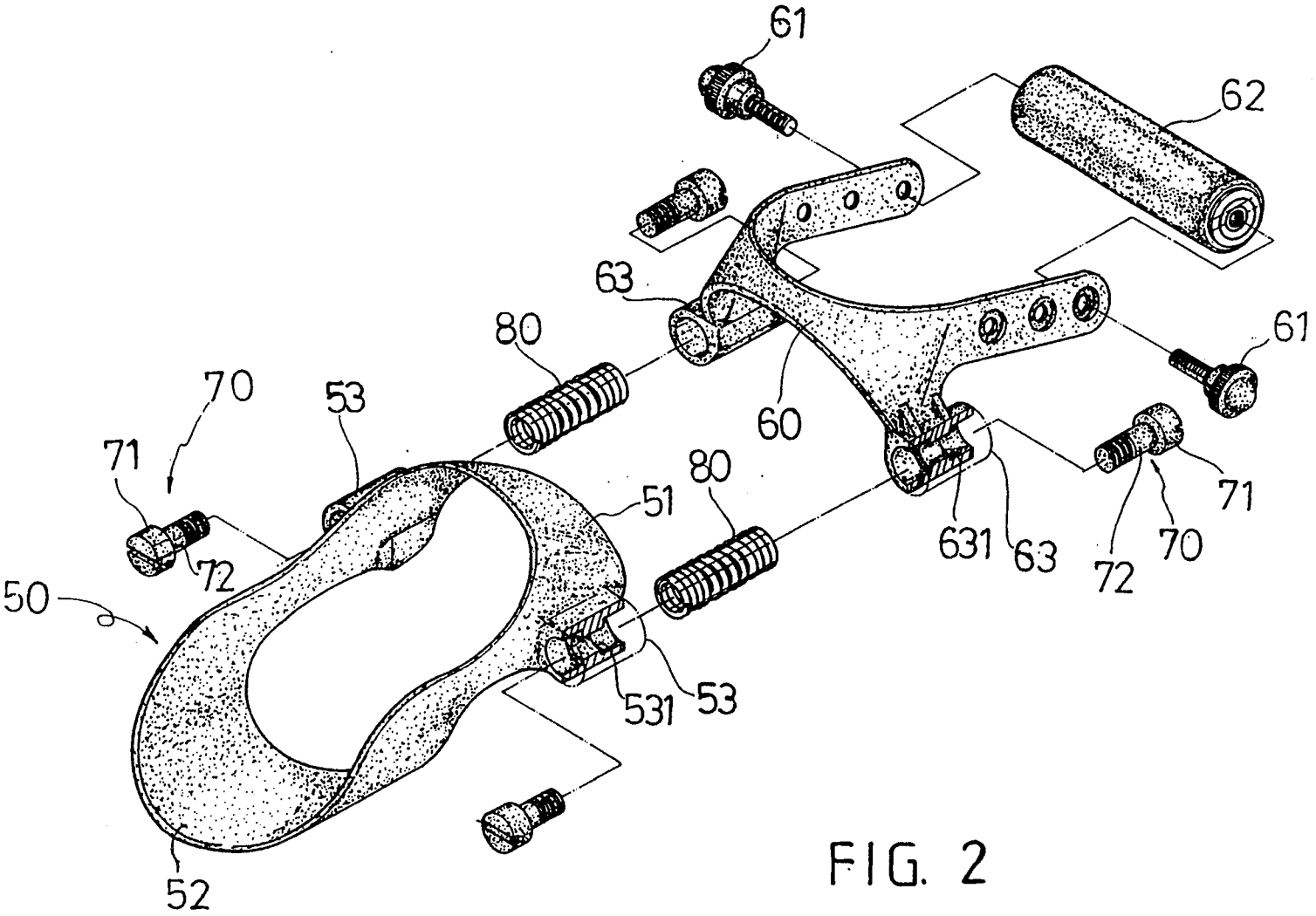
FIG. 2 is a perspective fragmented view of a preferred embodiment of the multi-directional rotational wrist exerciser according to the present invention.

As shown in FIG. 2, the wrist exerciser according to the present invention mainly consists of an arm covering body 50, a movable base 60, a plurality of bolts 70 and a plurality of spiral springs 80. The arm covering body 50 has an elongated frame body with two semi-arc portions 51 and 52 opposing to each other. The forward end of the arm covering body 50 has an open end positioning housing cover 53 on each edge. Said positioning housing cover 53 has an internal annular member 531 which is used to split up the inside of the positioning housing cover 53 into two containing spaces. The movable base 60 is configured to have a 'U' shape in which a handle 62 is attached to the open end of the U-shaped movable base 60 by means of connecting components 61. Each side of the bottom edge of the movable base 60 has a positioning housing 63, which has an internal annular member 631 for splitting up the positioning housing 63 into two containing spaces. The bolts 70 have threads in their shanks 72. The diameters of the bolts' heads 71 are equal to the inside diameters of the positioning housing cover 53 and the positioning housing 63. The diameters of the shanks 72 are equal to the inside diameters of the annular members 531 and 631 of the positioning housing cover 53 and the positioning housing 63. The spiral springs 80 are made from harden material, the pitches of the spiral springs 80 are made to be the same as the pitches of the threads of the bolts 70. The pitches at the center portion of the spiral spring 80 is larger than the pitches at both ends of the spiral springs 80.

Figure 3:
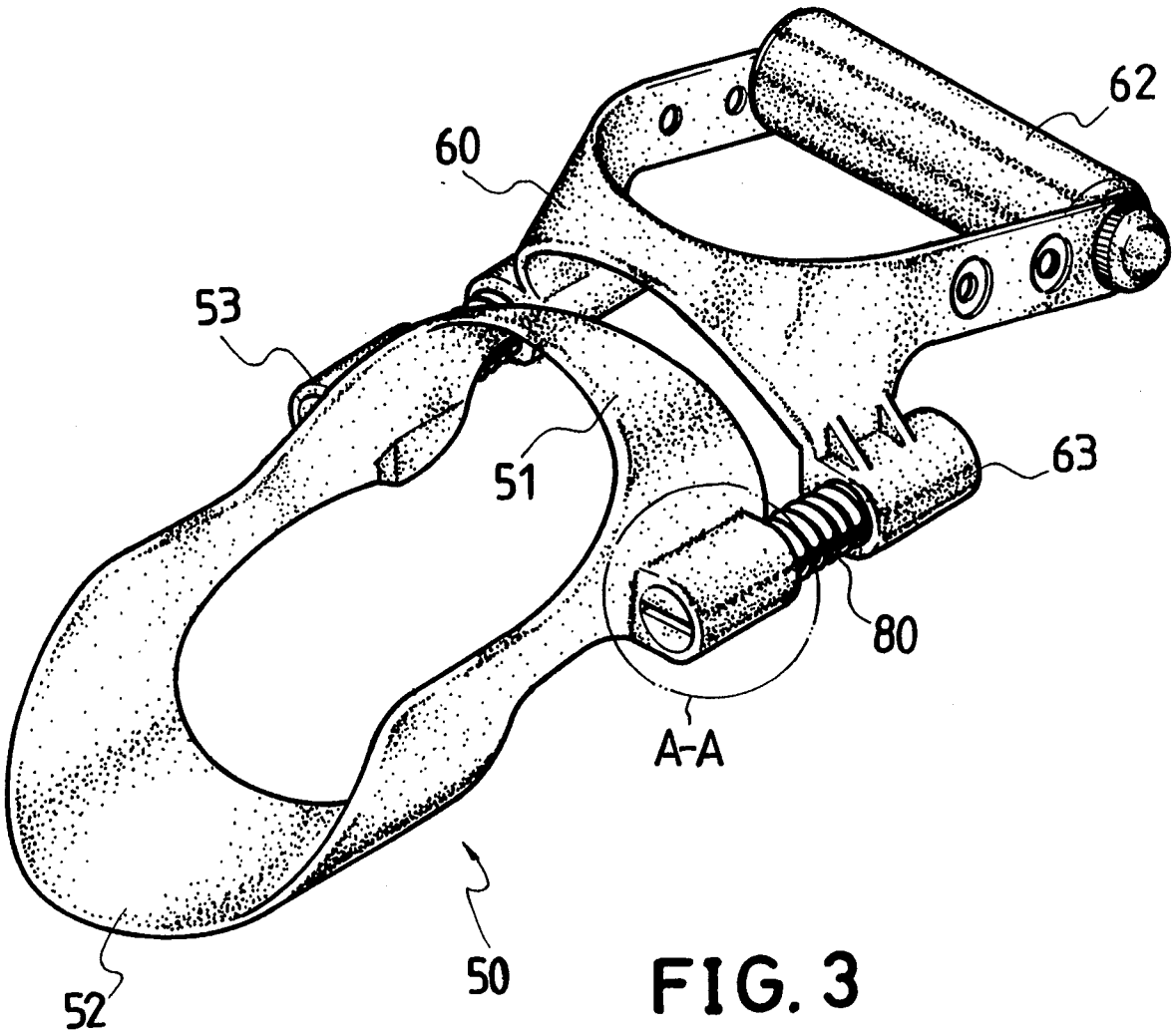
FIG. 3 is a perspective view showing the complete wrist exerciser assembly of the preferred embodiment of FIG. 2 according to the present invention.
Figure 3A:
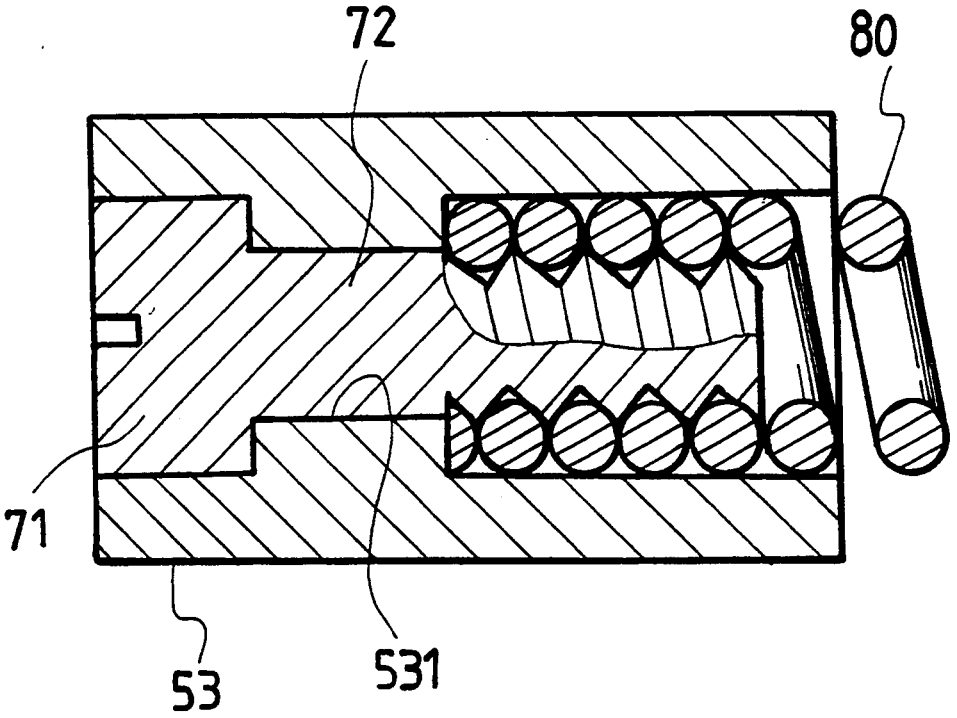
FIG. 3A is a detailed view taken along lines A—A of FIG. 3.

As shown in FIG. 3, both ends of the spiral spring 80 are respectively fitted into the positioning housing cover 53 and the positioning housing 63. One end of the spiral spring also butts against annular member 531 while the other end butts against the annular member 631. The other ends of the positioning housing cover 53 and the positioning housing 63 accept bolts 70. The bottom surfaces of each of the two bolts 70 butts against the top of the annular member 531 and 631. The shank 72 of the bolt 70 feeds through the annular member 531 and 631 to reach to the other end and secured with the spiral spring 80. By tightening the bolt 70 the spiral spring 80 can be secured and positioned in between the positioning housing cover 53 and the positioning housing 63, allowing the covering body 50 and the movable base 60 to be fastened together in a movable manner.

Figure 4A:
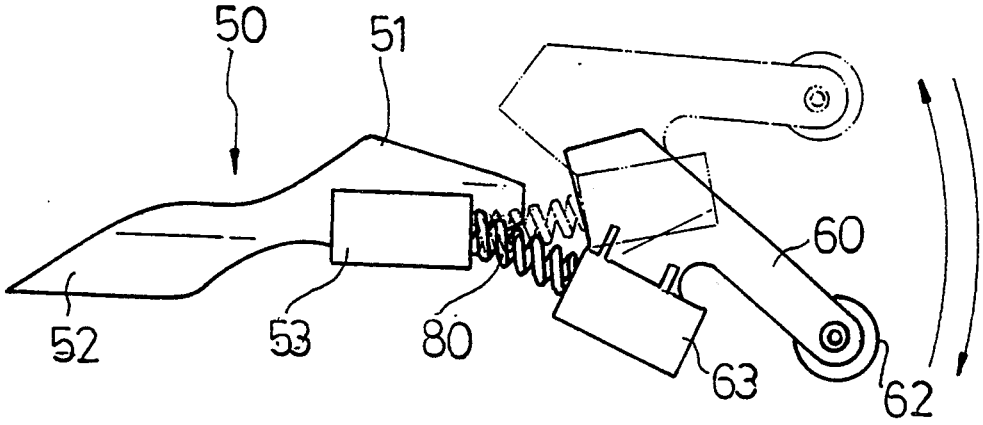
FIGS. 4A, 4B and 4C are the illustrative drawings showing the operation of the wrist exerciser from the previous embodiment according to the present invention.
Figure 4B:
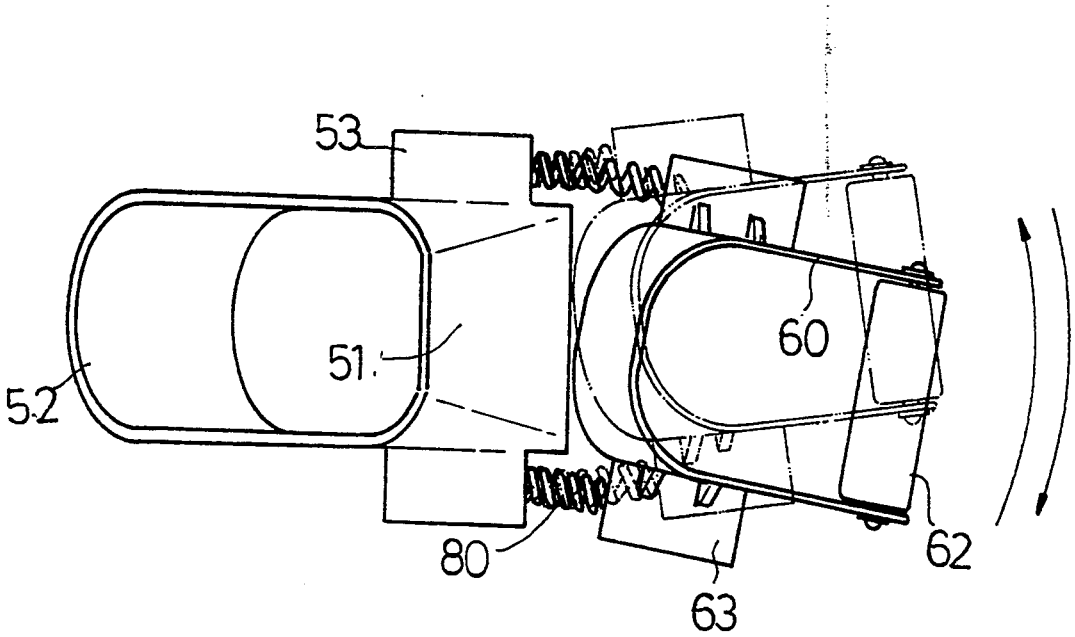
Figure 4C:
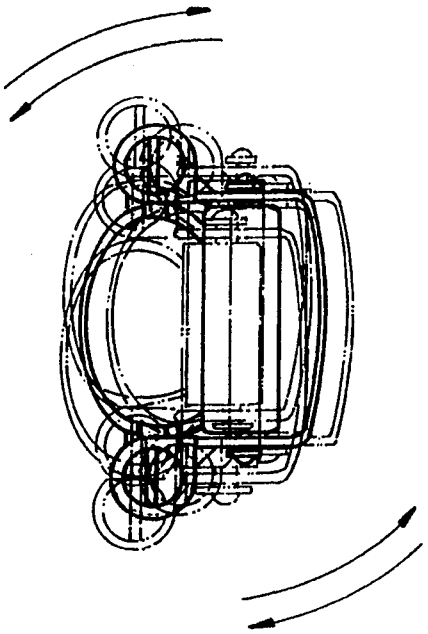

As shown in a preferred embodiment of the wrist exerciser in FIG. 4, a user's hand is sleeved into the covering body 50, the top semi-arc portion 51 and the bottom semi-arc portion 52 thereof allow the wrist exerciser according to the present invention to be positioned on the user's hand. The user's hand can grab onto the handle 62 of the movable base 60. By such configuration, when the user's wrist is exercising, the spiral spring 80 stretches out and generates a restoring force. The user has to overcome the resistance produced by the spiral spring 80 so as to reach the goal of exercising the wrist. It is worth mention that the movable base 60 and the covering body 50 are attached together by the spiral spring 80 which is made out of harden material, the user can therefore turn his wrist in any direction for exercising.

The new structure of the wrist exerciser according to the present invention has the following features:

1. As compare to the conventional wrist exerciser, in which the wrist can only turn up and down for exercising, the new structure of the wrist exerciser allows the user to turn his wrist in any direction so as to obtain the most effective wrist exercising.

2. The spiral spring 80 used in the new structure is made out of harden material, therefore, the tension of the spiral spring 80 will not be loosen up use after user. This eliminates the need to replace the spring component after a period of time, as it is done in the conventional wrist exerciser.

3. The spring used in the wrist exerciser according to the present invention may be replaced by a ball bearing structure so that the user can have a choice of a suitable wrist exerciser.

What is claimed is:

1. A multi-directional rotatable wrist exerciser comprising:

an arm covering body;

a movable base;

a plurality of bolts; and a plurality of spiral springs;

wherein said arm covering body has an elongated frame body with two semi-arc portions opposing each other, a forward end of the arm covering body has an open end substantially circular positioning housing cover on each edge, said positioning housing cover has an internal annular member which is used to split up the inside of the positioning housing cover into two containing spaces;

the movable base is configured to have a 'U' shape, in which a handle is attached to an open end of the U-shaped movable base by means of connecting components, each side of a bottom edge of the movable base has a substantially circular positioning housing, which has an internal annular member for splitting up the positioning housing into two containing spaces;

the bolts have threads in their shanks, the diameters of the bolts' heads are equal to the inside diameters of the positioning housing cover and the positioning housing, the diameters of the shanks are equal to the inside diameters of the annular members of the positioning housing cover and the positioning housing;

the spiral springs are made from harden material, the pitches of the ends of the spiral springs are equal to the pitches of the threads of the bolts, the pitches at the center portion of the spiral springs are greater than the pitches at both ends of each spiral spring;

both ends of each spiral spring are respectively fitted into the positioning housing cover and the positioning housing, one end of each spiral spring butts against a bottom of the annular member of the positioning housing cover while the other end butts against a bottom of the annular member of the positioning housing, the other containing spaces of the positioning housing cover and the positioning housing accepts said bolts, the bottom surfaces of the head of each of the bolts butts against top of the annular member and the shank of the bolts feed through the annular member, reach to the other containing space and secure to the spiral spring; and whereby tightening the bolt the spiral spring can be secured and positioned in between the positioning housing cover and the positioning housing, allowing the covering body and the movable base to be fastened together in a multi-directional movable manner.

* * * * *